United States Patent [19]

Chubb

[11] 4,129,014

[45] Dec. 12, 1978

[54] REFRIGERATION STORAGE AND COOLING TANK

[76] Inventor: Talbot A. Chubb, 5023 N. 38th St., Arlington, Va. 22207

[21] Appl. No.: 818,179

[22] Filed: Jul. 22, 1977

[51] Int. Cl.[2] ..... F24C 15/16

[52] U.S. Cl. ..... 62/333; 62/59; 62/434; 62/437; 165/104 S

[58] Field of Search ..... 165/104 S; 126/400; 62/59, 333, 430, 434, 437

[56] References Cited

U.S. PATENT DOCUMENTS

| | | | |
|---|---|---|---|
| 2,142,856 | 1/1939 | Lieb et al. | 62/59 |
| 2,160,389 | 5/1939 | Palmer | 62/59 |
| 2,990,693 | 7/1961 | Houplain | 62/59 |
| 3,653,221 | 4/1972 | Angus | 62/59 |
| 3,766,752 | 10/1973 | Laing | 62/59 |
| 4,010,731 | 3/1977 | Harrison | 165/104 S |
| 4,044,568 | 8/1977 | Hagen | 62/59 |
| 4,064,931 | 12/1977 | Laing | 62/59 |

*Primary Examiner*—Ronald C. Capossela
*Attorney, Agent, or Firm*—R. S. Sciascia; Philip Schneider; Melvin L. Crane

[57] ABSTRACT

A "coldness-storage" unit for use in a refrigeration storage and cooling tank system for nighttime coolant storage while providing for subsequent daytime cooling. The "coldness-storage" unit has a closed tank which includes a plurality of cans containing a liquid material which freezes at a temperature below room temperature. The outer surface of the cans are coated with a wicking surface and the tank includes a condensable liquid such as butane, which vaporizes to fill the unoccupied space in the tank with butane vapor. The ends of the wick covered cans touch the butane so that the butane wets the wicks. A refrigerator/compressoris operated to cool condensation coils in the tank. The butane vapors in the unoccupied space condense on the condensation coils giving off heat to the refrigerator/-compressor coils which lowers the vapor pressure within the tank. The butane evaporates from the wetted wicking surfaces of the cans in response to lowered vapor pressure, giving off additional vapors which condense on the condensation coils. The evaporating liquid cools the cans below freezing, thereby freezing the liquid in the cans. Pipes in the bottom of the tank within the liquid butane permit fluid circulation for carrying a coolant to a heat exchanger and returning hot fluid from the heat exchanger. The returning hot fluid causes boiling of the liquid butane, vaporizing the liquid butane. Concurrent condensation of butane vapors on the cans causes the frozen liquid in the cans to melt. As a result, a cool pool of liquid butane is maintained throughout the day to provide cooling during the day. During nighttime, the refrigeration unit is operated to refreeze the liquid in the cans as set forth above.

14 Claims, 1 Drawing Figure

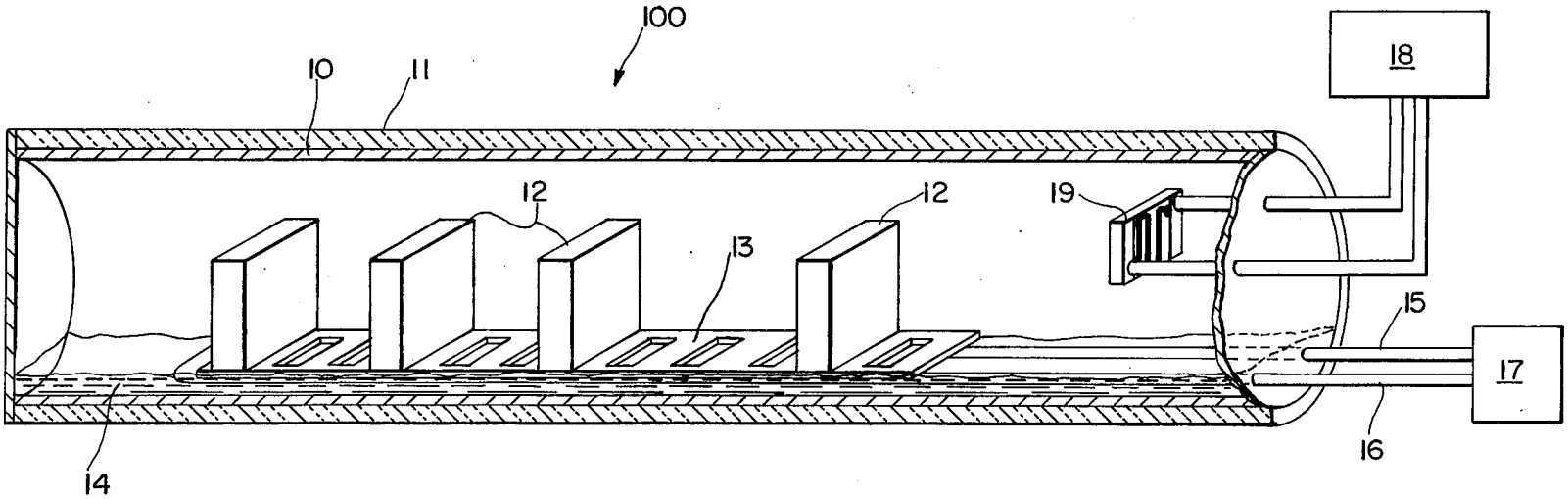
100
10
11
12
12
13
14
15
16
17
18
19

REFRIGERATION STORAGE AND COOLING TANK

STATEMENT OF GOVERNMENT RIGHTS

The invention described herein may be manufactured and used by or for the Government of the United States of America for governmental purposes without the payment of any royalties thereon or therefor.

BACKGROUND OF THE INVENTION

This invention is directed to a combination refrigeration-heat exchanger system which permits operation of the refrigeration system during nighttime hours for coolant freezing and storage, while providing cooling during the day without operation of the refrigeration unit.

Heretofore various types of apparatus have been used for cooling. Some units contain brine which is cooled by a cooler which in turn cools something else. Systems have been used for nighttime refrigeration cooling with separate daytime cooling. Some of these systems use as coolant means liquids which freeze during operation. These systems have a problem due to build-up of frozen solids on refrigeration coils which prevents efficient operation and also causes damage to the piping system due to freezing. Other refrigeration-cooler systems have been patented which operate to store a liquid coolant for future use. These systems vary in their structural arrangement and operation for coolant storage and cooling.

SUMMARY OF THE INVENTION

The present refrigeration-air conditioner system employs a heat transfer liquid which functions in combination with the cooling coils of an air conditioning unit and which carries heat from said coils to a coolant storage tank. In said coolant storage tank, containerized frozen coolant is melted during the day and indirectly refrozen during the night by the refrigeration coils. Heat transfer between the primary heat transfer fluid and the coolant cans is effectd by evaporation and condensation of heat pipe fluid. Likewise, heat transfer between the coolant cans and the refrigeration coils is effected by evaporation and condensation of the same "heat pipe" fluid. Since the refrigeration coils are not in direct contact with the coolant storage medium, no solids are deposited on the refrigeration coils. The refrigerator operates during the night, at which time commercial usage of power is relatively low. Therefore operation of such a system costs less than those that operate during the day or peak power time.

BRIEF DESCRIPTION OF THE DRAWING

The single FIGURE is a partial cross-section representing the relative parts of an embodiment of the invention.

DETAILED DESCRIPTION OF THE INVENTION

The "coldness-storage" unit 100 of the refrigeration storage and coolant system includes an airtight or gas-tight tank 10 made of any suitable material, such as steel, whose outside surface is covered with a thermal insulation blanket 11 of fiber glass, Styrofoam, or any other suitable heat-insulating material. The tank includes therein a plurality of side-by-side metal cans 12 of any desired dimensions such as 4 × 18 × 18 inches, which rest upon an open frame 13. A fluid 14 is in the bottom of the tank such that the lower end of the metal cans 12 make contact with the fluid 14. The outside surfaces of the metal cans are covered with a wicking material, such as blotting paper which are kept wet by the fluid in the bottom of the tanks. The cans are filled with a fluid that freezes at a temperature below room temperature, such as water. The bottom portion of the tank 10 below 13 upon which the cans rest contains a volume of "heat pipe" liquid 14, such as butane or any other suitable fluid that has a moderate vapor pressure at room temperature and is nonreactive to the liquid which fills the cans 12. Within the "heat pipe" liquid, are found parallel pipes 15 and 16 which are connected together at one end inside the tank with the opposite ends connected with a heat exchanger 17 on the outside of the tank. The heat exchanger and pipes 15 and 16 are filled with a heat transfer fluid such as antifreeze water which will not freeze due to the cooling from the heat pipe fluid. The pipe 15 passes hot fluid from the heat exchanger to the fluid circulation pipes within the tank and pipe 16 returns cold fluid back to the heat exchanger. The heat exchanger may be in a duct system which directs "return" hot air in a building through the heat exchanger, which cools the hot air. The cooled air is then forced into the different areas of the building by the duct system. At either end of the tank, an external refrigerator-compressor unit 18 is connected with a condensation pipe assembly 19 within the tank. The refrigerator-compressor unit cools the pipe assembly 19 within the tank during operation of the compressor, preferably at night. The gas compressor of the refrigerator unit operates for cooling in the same manner as that in a regular home refrigerator of the Freon type.

A simple explanation of the operation is as follows: Assuming that the system has been assembled and everything is at room temperature, the butane will evaporate to fill the void spaces in the tank with butane vapor. The refrigerator/compressor unit is operated and cools the condensation pipe assembly 19 to a temperature below 32° F. Butane vapor condenses on the condensation pipes to give off heat from within the tank to the condensation pipes. The heat given off to the condensation pipe assembly is delivered to the refrigerator/compressor unit which cools the refrigerant to keep the condensation pipe assembly below 32° F., thus removing the heat from the tank due to condensation of the butane vapor on the pipe assembly.

Liquid butane wets the wicking on the outside of the cans by contact of the wicking with the butane. As the butane is condensed by the cold pipe assembly lowering the vapor pressure in the tank, butane evaporates from the wicking surface on the outside of the water-filled cans thereby cooling the cans. As the cans are cooled, heat is removed from the water in the cans which cools the water. After sufficient operation, the water within the cans will freeze thereby storing coldness for future operation. Liquid butane boils in response to lowered vapor pressure, giving off vapors until the temperature of the liquid butane approaches the temperature of the condensation pipes and falls below 32° F. When the temperature of all contents of the tank approaches the temperature of the condensation pipes, temperature equilibrium is reached and the refrigerator/compressor will automatically stop operating, or may be manually stopped until future operation is desired.

During heat exchanger operation, the antifreeze water is circulated through the liquid butane, which cools the antifreeze water, and through the heat exchanger, which cools the air that passes over the cool antifreeze water. As the hot air is cooled by the heat exchanger, the antifreeze water is heated and fed back to the circulation pipes in the tank and through the cold butane which cools the hot water in the pipes and is returned to the heat exchanger as cold water. As the hot water in the pipes is cooled, heat is given off to the liquid butane thereby changing the butane vapor conditions within the tank to permit the liquid butane to boil. As the butane boils, butane vapor is produced which condenses onto the wick covered cans thereby melting the ice within the cans. As the ice melts, the cooled liquid butane flows off the wicked cans into the butane pool at the bottom of the tank to keep the butane cold, which in turn cools the antifreeze water circulated through the circulation pipes in the butane and the heat exchanger. Thus, the ice in the cans will keep the butane cold until all the ice is melted and the vapor conditions stabilize at the non-cold storage conditions of operation. Alternatively, the refrigerator/compressor may be started at a desired time prior to complete melting of all the ice to refreeze the water in the cans and prepare the system for additional future heat exchanger operation. Therefore, the water in the cans may be frozen during nighttime hours so as to provide daytime air conditioning due to the refrigeration-coolant storage.

The above-described system is highly efficient because there is only a small temperature drop separating the temperature of the condensation pipes and the "freeze" cans; and a small temperature drop between the exit temperature of the antifreeze water when leaving the tank and that of the "freeze" cans. These small temperature changes are obtained as a result of the efficiency of the heat transfer process using evaporation/condensation principles well known in heat-pipe technology.

Obviously many modifications and variations of the present invention are possible in light of the above teachings. It is therefore to be understood that within the scope of the appended claims the invention may be practiced otherwise than as specifically described.

What is claimed and desired to be secured by Letters Patent of the United States is:

1. A refrigeration cooling and coolant storage system for heat exchanger operation which comprises:
- a gas tight housing;
- a plurality of containers assembled within said housing;
- a first fluid which freezes at a temperature below room temperature within said containers;
- a volume of "heat pipe" liquid within said housing below said containers;
- pipe means immersed within said "heat pipe" liquid within said housing for circulating a second fluid having a freeze point less than that of said "heat pipe" liquid;
- a condensation pipe assembly within said housing positioned above said volume of "heat pipe" liquid;
- a refrigerator-compressor connected with said condensation pipe assembly for cooling said condensation pipe assembly by circulation of a volume of refrigerator fluid through said condensation pipe thereby producing freezing of said first fluid within said containers, and a heat exchanger connected with said pipe means immersed in said "heat pipe" liquid to be cooled by fluid circulating through said volume of "heat pipe" liquid.

2. A refrigeration cooling and coolant storage system for heat exchanger operation as claimed in claim 1 in which:
said "heat pipe" fluid is butane.

3. A refrigeration cooling and coolant storage system for heat exchanger operation as claimed in claim 2 wherein:
said first fluid is water.

4. A refrigeration cooling and coolant storage system for heat exchanger operation as claimed in claim 2 wherein:
said second fluid is water containing antifreeze.

5. A refrigeration cooling and coolant storage system for heat exchanger operation as claimed in claim 1 wherein:
said first fluid is water.

6. A refrigeration cooling and coolant storage system for heat exchanger operation as claimed in claim 5 wherein:
said second fluid is water containing antifreeze.

7. A refrigeration cooling and coolant storage system for heat exchanger operation as claimed in claim 1 wherein:
said second fluid is water containing antifreeze.

8. A closed "coldness storage" unit for use with a refrigerator/compressor unit and a heat exchanger in a refrigeration storage and cooling system comprising:
- a gas-tight housing;
- a plurality of containers within said housing;
- a first fluid, which freezes at a temperature below-room temperature, within each of said containers;
- a volume of "heat pipe" liquid within said housing just touching the bottom ends of said containers;
- pipe means immersed within said "heat pipe" liquid and extending outside said housing for connection with said heat exchanger;
- a second fluid, which has a freezing point below that of said "heat pipe" liquid, within said pipe means for circulation therethrough by said heat exchanger;
- condensation pipe means within said housing including pipes which extend outside of said housing for connection with said refrigerator/compressor unit; and
- a volume of refrigerator fluid within said condensation pipe means for circulation therethrough by said refrigerator/compressor unit,
- said refrigerator/compressor operating to cool said condensation pipe means thereby causing freezing of said first fluid in said container and cooling said "heat pipe" liquid, said fluid from said heat exchanger being cooled by circulation through said "heat pipe" fluid.

9. A closed "coldness storage" unit as claimed in claim 8 wherein:
said first fluid is water.

10. A closed "coldness storage" unit as claimed in claim 9 wherein:
said second fluid contains an antifreeze solution.

11. A closed "coldness storage" unit as claimed in claim 10 wherein:
said "heat pipe" liquid is butane.

12. A closed "coldness storage" unit as claimed in claim 9 wherein:
said "heat pipe" fluid is butane.

13. A closed "coldness storage" unit as claimed in claim 8 wherein:
said second fluid contains an antifreeze solution.

14. A closed "coldness storage" unit as claimed in claim 8 wherein:
said "heat pipe" liquid is butane.

* * * * *